United States Patent [19]

Sundin

[11] 4,215,710

[45] Aug. 5, 1980

[54] CURLER

[75] Inventor: Harry G. I. Sundin, Karlshamn, Sweden

[73] Assignee: AB Karlshamns Plastindustri, Karlshamn, Sweden

[21] Appl. No.: 930,428

[22] Filed: Aug. 2, 1978

Related U.S. Application Data

[63] Continuation-in-part of Ser. No. 742,282, Nov. 16, 1976, abandoned.

[51] Int. Cl.[2] ..... A45D 2/00

[52] U.S. Cl. ..... 132/40

[58] Field of Search ..... 132/40, 42, 39

[56] References Cited

U.S. PATENT DOCUMENTS

| | | | |
|---|---|---|---|
| 3,064,659 | 11/1962 | Solomon | 132/40 |
| 3,209,766 | 10/1965 | Dannat | 132/40 |
| 3,334,638 | 8/1967 | Behrens | 132/40 |
| 3,838,700 | 10/1974 | Barrios | 132/40 |
| 4,004,595 | 1/1977 | Slavinski | 132/40 |

*Primary Examiner*—G. E. McNeill

*Attorney, Agent, or Firm*—Brumbaugh, Graves, Donohue & Raymond

[57] ABSTRACT

A curler for setting hair comprising a spool hollowed to receive a pair of reciprocable pistons in the opposite ends thereof, the pistons carrying prongs at the adjacent ends thereof in opposed conical arrays and the prongs being adapted to be projected through longitudinally extending guide slots in the spool when the pistons are moved inwardly and to be withdrawn when the pistons are moved outwardly. The prongs are elastic, preferably conically tapering, and may be arranged such that the prongs on one piston, on shifting of the pistons towards each other, slide in between and engage with the prongs on the other piston for securing the pistons against unintentional separation, thus firmly securing the spool to the hair tress on which it is rolled.

11 Claims, 7 Drawing Figures

FIG. 4
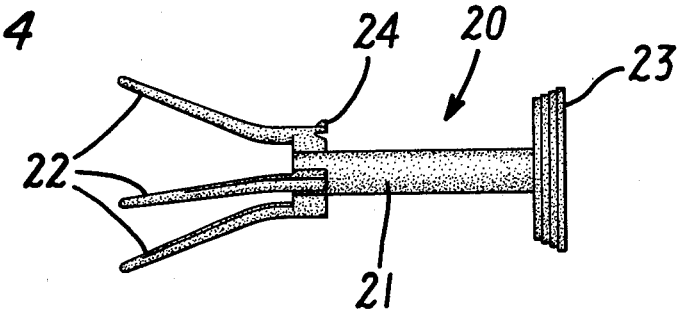
FIG. 3
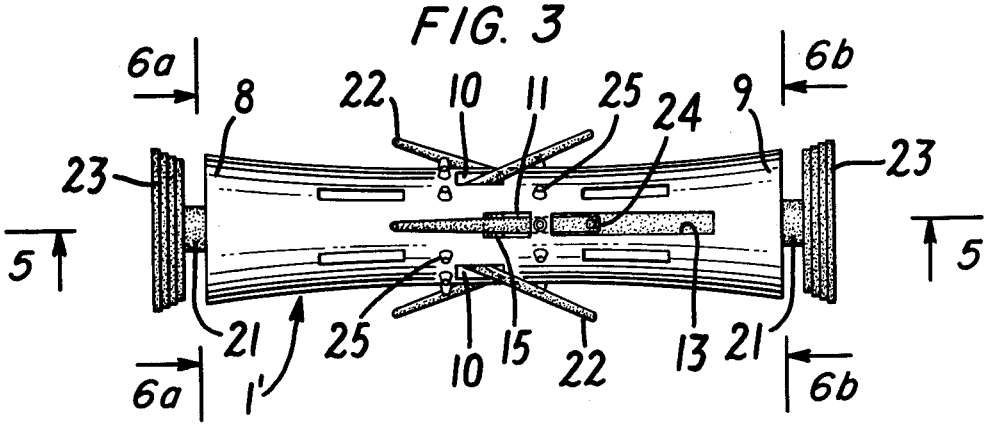
FIG. 5
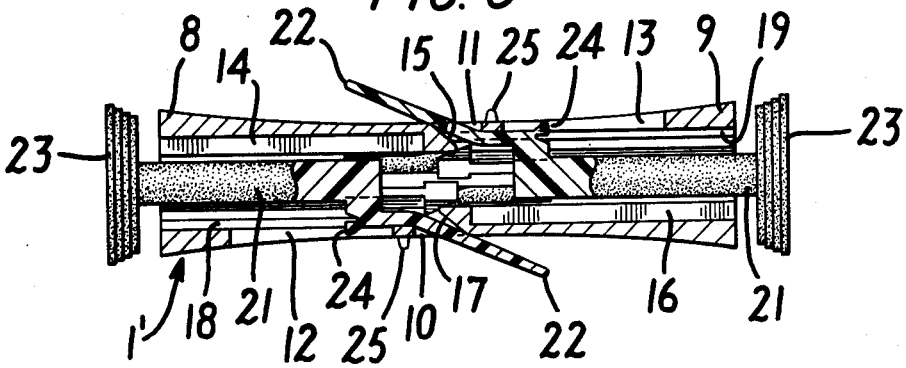
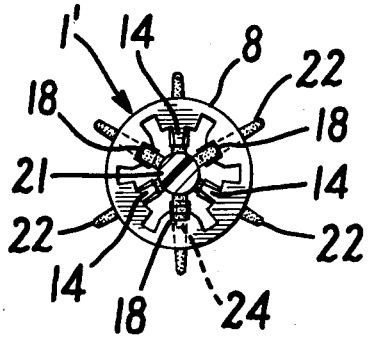
FIG. 6a
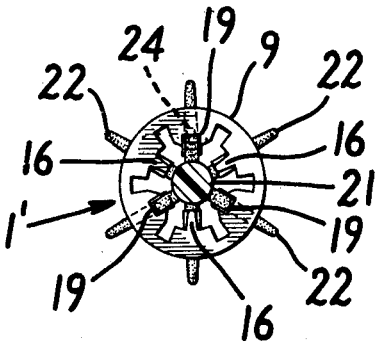
FIG. 6b

CURLER

This application is a continuation-in-part of my copending application Ser. No. 742,282, filed Nov. 16, 1976, now abandoned for "Curler."

BACKGROUND OF THE INVENTION

The present invention relates to a hair curler and more particularly to a curler in which a tress of hair is adapted to be retained on a hollow spool by prongs on the adjacent ends of pistons reciprocably mounted in the opposite ends of the spool, which prongs are projected through openings in the spool when the pistons are moved inwardly of the spool.

In curlers of this type, the spool or pistons are usually provided with hair-retaining prongs which, when a tress of hair is rolled onto the spool, catch and retain the tress and possibly extend away from the tress itself into adjacent hair for retaining the spool. In a curler of the prior art type, the spool contains one or more insert sleeves which are provided with obliquely forwardly/-outwardly directed prongs which extend out through radial holes in the spool wall so that the prongs form retaining means for the hair tress, the insert sleeve in certain cases being shiftable or pivotable relative to the spool for withdrawal or projection of the prongs through holes in the insert sleeve or in the spool. The combination of prongs and spool inserts of this type does not provide a desirable effect and can entail great disadvantages. While it is possible to retain a tress of hair on the spool by means of the prongs which are stuck through the tress, the disadvantage is that either the curler can be difficult to release from the hair or the curler and the tress are not securely retained so as to prevent the spool from unrolling from the tress.

An object of the present invention is to provide a new and improved curler of the type indicated which is substantially free from the above-described disadvantages of the prior art.

SUMMARY OF THE INVENTION

According to the invention, the pistons of the curler present a plurality of prongs which are directed obliquely forwardly/upwardly towards each other, the prongs extending from the pistons outwardly through longitudinally extending guide slots in the wall of the spool and being guided in axial grooves in the spool wall. Moreover, the prongs are arranged and dimensioned such that the prongs on one piston, when the pistons are shifted towards each other, slide in between the prongs on the other piston outside the spool.

According to a preferred embodiment of the invention, the prongs are conically tapered, are resilient, and are arranged such that, when the pistons are shifted towards each other, they form opposed, overlapping, conical arrays which fix the spool in a tress of hair rolled upon the spool. Since they are stuck through the tress, moreover, the prongs may be so disposed that when the pistons are simultaneously moved inwardly, they come into engagement with one another and secure the pistons against unintentional separation.

Each piston can be provided with a relatively small number of prongs, but the prongs should be uniformly distributed about the piston so that they extend conically outwardly from the one piston in a direction towards similarly arranged prongs on the other piston. For example, if the spool is provided with eight axial guide grooves distributed with equal spacing around the circumference of the spool, each piston should have at least eight conically forwardly-outwardly directed prongs and each prong should be pointed at its end and, in a per se known manner, be of conical shape so that it has its greatest diameter in the region of its base. The prongs may be arranged such that each prong on one piston glides towards an opposing prong on the other piston on shifting of the pistons towards each other, the prongs, by spring action, realizing a certain resistance against this shifting of the pistons towards each other and thereafter causing resistance against their separation.

DESCRIPTION OF REPRESENTATIVE EMBODIMENTS

The present invention and its aspects will be more clearly understood from the following detailed description taken in conjunction with the following drawings in which:

FIG. 3 is a front view of another form of curler embodying the invention;

FIG. 4 illustrates one of the prong carrying pistons for the curler shown in FIG. 3;

FIG. 5 is a view in transverse section taken along the line 5—5 of FIG. 3, looking in the direction of the arrows; and FIGS. 6*a* and 6*b* are views in transverse section taken along the line 6*a*—6*a* and 6*b*—6*b*, respectively, of FIG. 3, looking in the direction of the arrows.

Figure 1:
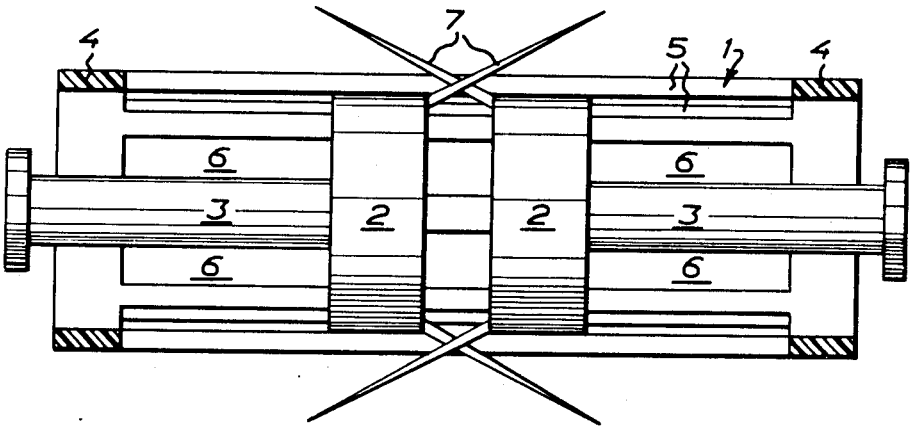
FIG. 1 shows a curler according to the present invention in axial section.
Figure 2:
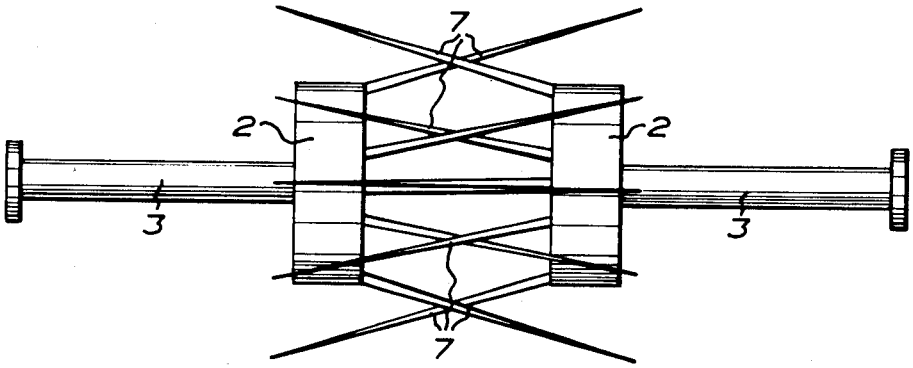
FIG. 2 is a schematic view of the pistons, provided with prongs, in the curler of FIG. 1.

The curler shown in FIGS. 1 and 2 comprises a cylindrical spool 1 housing a pair of pistons 2 which are shiftable towards and away from each other within the spool, each of the pistons being provided with an axial shaft 3 projecting outwardly from the spool and serving as a grip.

The spool wall consists of two annular end members 4 and a number, for example eight, of axial ribs 5 which connect the end members 4 and are equally spaced from each other about the circumference of the spool. The ribs 5 define axial slots 6, whose function will be described in greater detail hereinbelow, and are designed integrally with the annular wall elements 4 at the ends of the spool. The spool may possibly have, in its middle portion, an annular wall element (not shown) and the ribs 5 may possibly extend with their inner longitudinal edges a distance radially inside the inner circumferential surface of the annular spool wall elements, in which case the pistons 2 should be provided with guide grooves on their circumference for being guided by the ribs.

The pistons 2 are provided with a number of prongs 7 corresponding to the number of slots 6 extending obliquely forwardly/outwardly in opposed conical arrays. Th prongs 7 extend from the pistons 2 out through the guide slots 6 a distance beyond the outer circumference of the spool 1. Each prong 7 is conical in form, with the greatest diameter at its base and tapering outwardly towards the pointed end. Moreover, the prongs are resilient with increasing rigidity towards the base. The diameter of the prongs can be, for example, about 0.5 mm at the end portion and about 2 mm at the base.

In the use of the curler according to the invention, the pistons 2 are first pulled apart and the end of a tress of hair which is to be rolled up is laid on the spool and stuck in between the ribs 5 of the spool 1, whereupon the spool is rolled up on the tress in the normal way. Both of the pistons 2 are then shifted towards each other so that the prongs 7 are stuck through the hair tress and in opposed, overlapping conical arrays. The pistons are hereby fixed to each other in that the conical prongs on one piston engage by spring force and friction with the prongs on the other piston.

The guide slots 6 between the ribs 5 can be dimensioned such that corresponding prongs on the two pistons, which are brought together and cross each other, are also clamped fast against adjacent ribs 5, thus applying a certain clamping force against the hair. The pistons being fixed in this position with the prongs 7 pressed against the end of the hair inserted in the spool, they and the spool are safely retained fixed to the hair tress so that the spool cannot then roll off the hair tress.

The ribs 5 can, naturally, be provided with short hair retention prongs on their outer edges, but this will be unnecessary because of the arrangement of the prongs 7 on the pistons 2 according to the invention. It has been found that a relatively small number of prongs on the pistons, for example eight prongs on each piston, provides a fully sufficient effect of the above-described type.

In order to release the curler from the hair, the pistons are first pulled apart from each other, the prongs being lightly pulled out from the hair tress without any tendency to fasten in the hair. In this fashion, the spool can easily be released from the tress.

The pistons 2 with the grip 3 and the prongs 7 can easily be produced integrally by extrusion of plastics, such as polyamide plastics, and the manufacture of the curler is, thus, simple and straightforward.

The pistons are preferably designed such that they form sealing plugs in the spool. As a result, in drying hair in a stream of hot air, the hot air introduced into the spool is forced to dissipate radially outwardly through the guide grooves 6 of the spool wall and through the hair. As a result, the problem of air blowing straight through the spool without having any drying effect on the hair is avoided.

Another advantage of the curler described above is the simple design of the spool wall with parallel ribs 5 and only a couple of annular wall members 4 at the ends. As has previously been mentioned, however, the spool can also have one or two annular wall members in its central portion for bending the prongs outwardly on shifting of the pistons towards each other, and to reinforce the ribs 5.

In the embodiment shown in FIGS. 3 through **6*b*, the spool 1' is of minimum diameter intermediate the ends and gradually tapers to maximum diameter at the opposite ends 8 and 9. Disposed in staggered relation on opposite sides of a median circle intermediate the ends 8 and 9 are a plurality of short, angularly spaced apart, longitudinal guide slots 10 and 11. Also, an elongated slot 12 extends between one of the slots 10 and the spool end 8, and another elongated slot 13 extends between one of the slots 11 approximately 180° away and the end 9**.

The end 8 of the spool 1' is hollow and formed with a plurality of angularly spaced apart, longitudinally extending lands 14 (FIG. **6*a*) which terminate in short, inwardly extending ramps 15 beginning at the ends of the guide slots 11 nearest the median circle, respectively. The spool end 9 is also hollow and formed with a plurality of angularly spaced apart, longitudinally extending lands 16 (FIG. 6*b*) terminating in short, inwardly extending ramps 17 beginning at the ends of the guide slots 10** nearest the median circle, respectively.

Between each adjacent pair of lands 14 is a longitudinally extending internal groove 18, the grooves 18 terminating at the ends of the guide slots 10 farthest from the median circle. In similar fashion, a longitudinally extending groove 19 is formed between each pair of lands 16, the grooves terminating at the ends of the guide slots 11 farthest from the median circle.

The lands 14 and 16 serve as bearings for the pistons 20, one of which is shown in FIG. 4. Each piston 20 comprises a rod 21 having a plurality of resilient prongs 22 secured at one end in angularly spaced apart relation and in generally conical array and a button 23 at the other end. One of the prongs 22 is formed with an outwardly and rearwardly extending projection 24 which serves, as described below, to prevent the piston 20 from being inadvertently pulled out of the spool 1'.

A piston 20 is inserted in the end 8 of the spool 1' by depressing the free ends of the prongs 22, positioning them in alignment with the grooves 18 such that the prong 22 with the projection 24 faces the groove 18 underlying the slot 12, and pushing the piston 20 into the spool 1'. During inward movement of the prongs 22 in the grooves 18, the projection 24 snaps outwardly into the slot 12 and serves thereafter as a stop to limit inward and outward movement of the piston 20. In like fashion, another piston 20 is inserted into the open end 9 of the spool 1'.

In use of the curler, the buttons 23 are pulled outwardly until the prongs 22 on the pistons 20 are withdrawn into the spool 1', a hair tress is rolled upon the reduced diameter portion of the latter, and the buttons are then pushed inwardly as far as they can go. During inward movement of the pistons 20, the ramps 17 perform a camming function and bend the prongs 22 on the left-hand piston 20 so that they are extended through the guide slots 10 in a substantially conical array overlying the right central portion of the spool 1' as shown in FIG. 3.

The ramps 15 perform similar camming functions and bend the prongs 22 on the right-hand piston 20 so that they are extended through the guide slots 11 in a substantially conical array overlying the left central portion of the spool 1'. The extended prongs 22 on the two pistons 20, emerging from their respective slots 10 and 11 at points lying substantially on a median circle in the wall of the spool 1', and projecting in opposite directions in overlapping conical arrays as shown in FIG. 3, fasten the tress securely on the spool 1'. If desired, the spool 1' may be provided with short, angularly spaced apart projections 25 to aid in holding the hair tress securely.

The invention thus provides novel and highly effective curler means for setting hair which is easy to use and remains securely in place during the period of use.

The several embodiments disclosed herein are merely illustrative and modifications in form and detail are possible within the scope of the following claims.

I claim:

1. A curler comprising a tubular spool having a plurality of angularly spaced apart, longitudinally extending guide slots formed therein, a pair of piston members slidably mounted in the opposite hollow ends of said spool, a plurality of prongs on each of said piston members in positional correspondence with said respective guide slots and adapted to extend therethrough in substantially conical array at an acute angle to the longitudinal axis of the spool and with the prongs of said respective arrays in opposed relation, and manually operable means enabling axial in and out movement of said piston members in said spool, said prongs and guide slots being so arranged that said piston members can be moved outwardly to a position in which the conical arrays of their prongs do not overlap, and inwardly to a central position where the arrays of prongs extend from their respective guide slots and overlap substantially along a circle concentric with the longitudinal axis of the spool and extend upwardly and outwardly in opposite respective directions from the spool for substantially their full lengths.

2. A curler as defined in claim 1 in which the prongs are resilient and taper from a relatively thick base portion to a relatively narrow tip.

3. A curler as defined in claim 2 in which the spool comprises two annular end wall members having plurality of axial ribs therebetween defining said guide slots.

4. A curler as defined in claim 2 in which the spool is formed with a first plurality of angularly spaced apart, longitudinally extending guide slots between the center and one end thereof, and with a second plurality of angularly spaced, longitudinally extending guide slots between the center and the other end thereof, and the prongs on said pair of pistons are adapted to be extended through said respective first and second guide slots.

5. A curler as defined in claim 4 in which the guide slots in said second plurality are disposed in staggered angularly spaced relation to the guide slots in said first plurality.

6. A curler as defined in claim 5 together with means for maintaining the prongs on one of said pistons in positional correspondence with the respective guide slots farthest therefrom, and means for maintaining the prongs on the other of said pistons in positional correspondence with the respective guide slots farthest therefrom.

7. A curler as defined in claim 6 together with first means for camming the prongs on said one piston outwardly through the respective guide slots nearest thereto in substantially conical array at an acute angle to the longitudinal axis of the spool, and second means for camming the prongs on said other piston outwardly through the respective guide slots nearest thereto in substantially conical array at an acute angle to the longitudinal axis of the spool, said guide slots and first and second camming means being so arranged that when said pistons are moved inwardly, the arrays of prongs thereon emerge from said guide slots and overlap substantially along a median circle concentric with the longitudinal axis thereof and extend in opposed, substantially conical, arrays overlying the central portions of the spool.

8. A curler as defined in claim 7 together with bearing means for supporting said respective piston means in the opposite ends of the spool, and means retaining said pistons releasably in the spool.

9. A curler as defined in claim 2 in which the prongs on the respective piston members come into frictional engagement near their base portions when the piston members are moved to the closed position.

10. A curler as defined in claim 2 in which the prongs are about 2 mm thick at the base and about 0.5 mm thick immediately before the tip.

11. A curler as defined in claim 12 in which the spool comprises two annular end wall members and a third annular wall member therebetween with a first plurality of axial ribs between one end wall member and said third end wall member defining a first plurality of guide slots for the prongs on one of said piston members, and with a second plurality of axial ribs between the other end wall member and said third end wall member defining a second plurality of guide slots for the prongs on the other of said piston members.

* * * * *

UNITED STATES PATENT AND TRADEMARK OFFICE

CERTIFICATE OF CORRECTION

PATENT NO. : 4,215,710

DATED : August 5, 1980

INVENTOR(S) : Harry Gideon Inqvar Sundin

It is certified that error appears in the above—identified patent and that said Letters Patent is hereby corrected as shown below:

Col. 2, line 33, "line" should read --lines--;

Col. 2, line 59, "Th" should read --The--; and

Col. 6, line 30, "claim 12" should read --claim 2--.

Signed and Sealed this

*Twenty-fifth* Day of *November 1980*

[SEAL]

*Attest:*

SIDNEY A. DIAMOND

*Attesting Officer*

*Commissioner of Patents and Trademarks*